US005831390A

United States Patent [19]

Inoue et al.

[11] Patent Number: 5,831,390

[45] Date of Patent: Nov. 3, 1998

[54] CRT WITH A TRANSPARENT FILM AND A COMPENSATING ELECTRODE

[75] Inventors: Toshiaki Inoue; Takeshi Ishizaki, both of Fukaya, Japan

[73] Assignee: Kabushiki Kaisha Toshiba, Kawasaki, Japan

[21] Appl. No.: 900,067

[22] Filed: Jul. 23, 1997

[30] Foreign Application Priority Data

Jul. 25, 1996 [JP] Japan ..... 8-195908
Oct. 9, 1996 [JP] Japan ..... 8-268055

[51] Int. Cl.[6] ..... H01J 1/52

[52] U.S. Cl. ..... 315/85; 315/8; 348/819

[58] Field of Search ..... 315/8, 85, 370; 348/819, 820

[56] References Cited

U.S. PATENT DOCUMENTS 5,151,635 9/1992 Cappels ..... 315/370
5,260,626 11/1993 Takase et al. ..... 315/85
5,451,840 9/1995 Abe et al. ..... 315/85
5,475,287 12/1995 Okuyama et al. ..... 315/370

FOREIGN PATENT DOCUMENTS 4-249036 9/1992 Japan .
5-74374 3/1993 Japan .
7-142008 6/1995 Japan .
7-298169 11/1995 Japan .
8-115685 5/1996 Japan .

*Primary Examiner*—Robert J. Pascal
*Assistant Examiner*—Justin P. Bettendorf
*Attorney, Agent, or Firm*—Pillsbury Madison & Sutro LLP

[57] ABSTRACT

A transparent conductive film is formed on an outer surface of a face portion of a face panel and a phosphor screen is formed on an inner surface thereof. A conductive explosion proof band is wound around an outer periphery of a skirt portion of the face panel and the explosion proof band has a grounding potential. A conductive tape is attached along a long side of the face panel and electrically connects the transparent conductive film with the explosion proof band. A compensating electrode extending along a side of the face panel is attached to an upper side of the skirt portion and disposed on a side opposite to the conductive tape with respect to the explosion proof band. An inverse voltage applying portion applies a voltage having a waveform of a polarity inverse to that of the deflection voltage applied to a deflection device to the compensating electrode so as to generate an electric field for canceling an alternating electric field generated from the deflection device.

14 Claims, 4 Drawing Sheets

CRT WITH A TRANSPARENT FILM AND A COMPENSATING ELECTRODE

BACKGROUND OF THE INVENTION

The present invention relates to a cathode ray tube and a cathode ray tube apparatus and more particularly to a cathode ray tube and a cathode ray tube apparatus having means for restricting alternating electric field irradiated from the cathode ray tube.

With a recent accelerated progress of personal computers and the peripherals, opportunity of long hour use of an image display unit at a relatively short distance has been increasing. In such a situation, there is a fear that low frequency alternating electric field irradiated from an image display unit comprising a cathode ray tube may affect human body badly and therefore an art for restricting the influence has become more important. Particularly, North European countries have specified standards relating to the AEF (Alternating Electric Field) so as to restrict so-called unrequited radiating electric field.

As a typical standard relating to AEF, MPR-2 established in Sweden has been known widely and TCO guideline more strict than the MPR-2 standard has been specified by the Swedish Confederation of Professional Employees. According to this TCO guideline, it is specified that in VLF (very low frequency) range in which the frequency is from 2 kHz to 400 kHz, the electric field value should be equal to or less than 1.0 (V/m)(in a region apart by 30 cm from the front surface of a cathode ray tube and by 50 cm from the periphery thereof) and in ELF (extremely low frequency) range in which the frequency is from 5 Hz to 2 kHz, the electric field value should be equal to or less than 10 (V/m) (30 cm off the front surface of the cathode ray tube).

In the image display unit using the cathode ray tube, magnetic fields are generated by supplying sawtooth shaped horizontal deflection current and vertical deflection current to a horizontal deflection coil and a vertical deflection coil respectively, so as to deflect and scan an electron beam, thereby projecting a picture image on the phosphor screen. Usually, the vertical deflection current is as low as several tens Hz. On the contrary, the horizontal deflection current is relatively high, usually several tens kHz. For producing sawtooth shaped current, thus, a high pulse voltage of about 1 kV is applied to the horizontal deflection coil, in retrace period. Alternating electric field in VLF band is irradiated from the horizontal deflection coil by supplying the pulse voltage.

In a cathode ray tube type image display unit such as a display monitor, by providing at its rear face and side face except the image display face (front face) with metallic plates or the like, irradiation of alternating electric field can be shielded so as to shield unrequired radiant electric field easily. However, the front face of the display unit cannot be shielded by an untransparent metallic plate because this is the portion for displaying images.

It has been found that sawtooth shaped alternating electric field is irradiated from the phosphor screen in the horizontal deflection period. This possible reason is that although a high voltage of 25 kV–30 kV is usually applied to the phosphor screen of the cathode ray tube so as to accelerate electron beams toward the phosphor screen, the potential of the phosphor screen gradually drops due to striking of electron beams or minus charges in the screen display period, and in the retrace period, no electron beam comes to the phosphor screen and therefore the potential is returned to plus side.

Thus, there is provided a method in which transparent conductive film is formed on the display surface of the cathode ray tube and is connected to the grounding in order to reduce unrequited radiant electric field leaking from the image display surface of the cathode ray tube. However, the method for forming transparent conductive film having a sufficiently low resistance to satisfy the TCO guide line has a problem in terms of production cost.

Thus, as disclosed in Jpn. Pat. Appln. KOKAI Publication No. 4-249036, a conductive tape is attached along the periphery of the face panel of the cathode ray tube over the transparent conductive film formed on the surface of the face panel, and an end of the tape is connected to the explosion proof band which is wound around the skirt portion of the cathode ray tube and connected to the grounding, thereby lowering resistance value of the transparent conductive film equivalently.

As a first method for reducing pulse type electric field irradiated from the horizontal deflection coil, there has been provided a method in which a graphite conductive film coated on an external surface of the funnel of the cathode ray tube is extended up to the cone portion and the neck portion, on which a deflection coil is mounted, and is connected to the grounding so as to form a shield, as disclosed in Jpn. Pat. Appln. KOKAI Publication No. 5-74374.

As a second method, as disclosed in Jpn. Pat. Appln. KOKAI Publication No. 4-315741, there has been provided a method in which an inverse pulse voltage in which polarity is inverse to the pulse voltage applied to the horizontal deflection coil is applied to an electrode located in the vicinity of a front face of the cathode ray tube so as to irradiate inverse pulse electric field, thereby canceling or reducing the pulse electric field irradiated from the horizontal deflection coil.

Further, as a third method, as disclosed in Jpn. Pat. Appln. KOKAI Publication No. 7-142008, an inverse pulse voltage is applied to an electrode disposed between an opening portion of the deflection coil and a graphite conductive film coated on the external surface of the funnel and connected to the grounding so as to irradiate inverse pulse electric field, thereby canceling and reducing the pulse electric field irradiated from the horizontal deflection coil.

However, according to the method in which the resistance value of the transparent conductive film is equivalently reduced by the conductive tape, there is a problem that if the conductive tape is attached to such an extent that a sufficient low resistance is ensured, the display screen becomes narrow.

Further, according to the first method in which the graphite conductive film is extended up to the cone and neck portions on which the deflection coil is mounted, it is necessary to cover a portion from the cone portion to the neck portion with an insulating sheet so as to prevent an occurrence of discharge between the deflection coil and the graphite conductive film. Thus, when a wedge is fitted in between the funnel and the deflection coil to fix the deflection coil, the insulating sheet is turned over, thereby considerably reducing work efficiency.

According to the second method in which an electrode for generating an inverse pulse electric filed is disposed in the vicinity of the front face of the cathode ray tube, although the pulse electric field from the deflection coil can be effectively reduced on the front of the cathode ray tube, the inverse pulse electric field is emitted from the both sides of the image display unit, so that a restriction value may not be satisfied. Further, in order to dispose an electrode, the cabinet of the image display unit needs to be structured in a special configuration.

Further, according to the third method in which an electrode for generating the inverse pulse electric field is disposed between a graphite conductive film and a deflection coil opening which are provided on an external surface of the funnel of the cathode ray tube, a position of the inverse pulse electrode is far from the image display surface of the cathode ray tube, therefore it is necessary to apply a quite high inverse pulse voltage although it does not need to be as high as a pulse voltage applied to the deflection coil.

Further, the problem regarding the sawtooth shaped alternating electric field irradiated from the phosphor screen cannot be resolved by the method in which the graphite conductive film is extended up to the cone and neck portions to be mounted with the deflection coil or the method in which the pulse electric field is canceled by the reverse pulse electric field generated from the reverse pulse electrode.

Although there is provided a method in which an internal conductive film and an external conductive film are disposed on the inner and outer surfaces of the funnel with interposing the funnel glass therebetween so as to obtain static electric capacity, as a method for stabilizing high voltage potential within a cathode ray tube. There exists a relatively high resistance such as a pin dag in terms of electricity between the internal conductive film inside of the funnel and the phosphor screen, so that it does not contribute sufficiently to stabilization of potential on the screen.

BRIEF SUMMARY OF THE INVENTION

Accordingly, the present invention has been contrived in consideration of the above-mentioned circumstances, and its object is to provide a cathode ray tube which can effectively restricts both pulse electric field emitted from a horizontal deflection coil and sawtooth electric field emitted from a phosphor screen so as to satisfy the TCO guideline, and a cathode ray tube apparatus having the cathode ray tube.

To achieve the object, according to an aspect of the present invention, there is provided a cathode ray tube comprising: an envelope including a face panel having a substantially rectangular face portion and a rectangular frame like skirt portion extending from the peripheral edge of the face portion, a funnel attached to the skirt portion, and a neck extending from the funnel; a phosphor screen formed on an inner surface of the face portion; a transparent conductive film formed on an outer surface of the face portion; an explosion proof band having conductivity and wound around an external surface of the skirt portion; an electron gun disposed in the neck for emitting an electron beam toward the phosphor screen; a deflection device arranged around an outer circumference of the funnel, for deflecting the electron beams; a band-shaped conductive member provided on the outer surface of the face panel and electrically connecting the transparent conductive film and the explosion proof band; and a compensating electrode disposed on the outer surface of the skirt portion and to which a voltage, having a waveform of a polarity inverse to that of a deflection voltage applied to the deflection device, is applied.

According to another aspect of the present invention, there is provided a cathode ray tube apparatus comprising: an envelope including a face panel having a substantially rectangular face portion and a rectangular frame like skirt portion extending from the peripheral edge of the face portion, a funnel attached to the skirt portion, and a neck extending from the funnel; a phosphor screen formed on an inner surface of the face portion; a transparent conductive film formed on an outer surface of the face portion; an explosion proof band having conductivity and wound around an external surface of the skirt portion; an electron gun disposed in the neck for emitting an electron beam toward the phosphor screen; a deflection device arranged around an outer circumference of the funnel, for deflecting the electron beam; a band-shaped conductive member provided on the outer surface of the face panel and electrically connecting the transparent conductive film and the explosion proof band; a compensating electrode disposed on the outer surface of the skirt portion; and drive means including a voltage supplying portion for supplying a deflection voltage with a predetermined waveform to the deflection device, and an inverse voltage supplying portion for supplying a voltage having a waveform with a polarity inverse to that of the deflection voltage to the compensating electrode.

In the above cathode ray tube and cathode ray tube apparatus of the present invention, the compensating electrode is disposed on the skirt portion and located between the explosion proof band and the funnel.

According to the present invention, the band-shaped conductive member is disposed along a side of the face portion while a lengthwise size thereof is set to be 50% or more an effective screen size of side one side.

According to the present invention, the transparent conductive film has a resistance equal to or lower than $1\times10^{10}$ $\Omega/\square$ per unit area.

The cathode ray tube and the cathode ray tube apparatus having such a construction restrict alternating electric field leaking from the cathode ray tube by means of the compensating electrode, the transparent conductive film and the band-shaped conductive member.

Specifically, by applying a voltage to the compensating electrode, the voltage having a waveform which is synchronous with and has a polarity inverse to the waveform of the deflection voltage to be applied to the deflection coil of the deflection device, in particular to the horizontal deflection coil, the compensating electrode generates an electric field for canceling pulse type alternating electric field irradiated from the horizontal deflection coil is generated. It is preferable that this compensating electrode is disposed on the skirt portion of the face panel, and on a side of the neck relative to the explosion proof band.

Setting the compensating electrode at this position, it is possible to generate canceling electric field relatively effectively in a direction of the front face of the cathode ray tube. Since the sides of an ordinary monitor utilizing the cathode ray tube are shielded by metallic chassis, no leak of the canceling electric field occurs in the direction of the sides so that excessive compensation in the direction of the sides can be restrained.

Further, the transparent conductive film is formed on an outer surface of the face portion of the cathode ray tube and the transparent conductive film is electrically connected to the explosion proof band by means of the conductive band-shaped member. Since the explosion proof band has grounding potential, the transparent conductive film shields alternating electric field irradiated in the direction of the front face of the cathode ray tube.

Against sawtooth shaped alternating electric field derived from potential fluctuation in the phosphor screen, the conductive band-shaped members are attached on both sides or a single side of at least one of the long sides or short sides of the face panel such that the band-shaped member is stretched from the front end of the explosion proof band to the peripheral edge of the outer surface of the face portion, thereby forming static electric capacity between the phosphor screen and the conductive band-shaped member connected to the grounding. Consequently, it is possible to increase the static electric capacity in that panel portion which is electrically nearest to the explosion proof band connected to the grounding and the phosphor screen, thereby stabilizing the potential of the phosphor screen.

Thus, according to the cathode ray tube of the present invention, not only shielding in all directions of the cathode ray tube is enabled but also an electric field of an inverse polarity is generated against pulse type alternating electric field so as to restrict the alternating electric field and further potential fluctuation in the phosphor screen is stabilized against the sawtooth shaped alternating electric field.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, a cathode ray tube apparatus according to an embodiment of the present invention will be described in detail with reference to the accompanying drawings.

Figure 1:
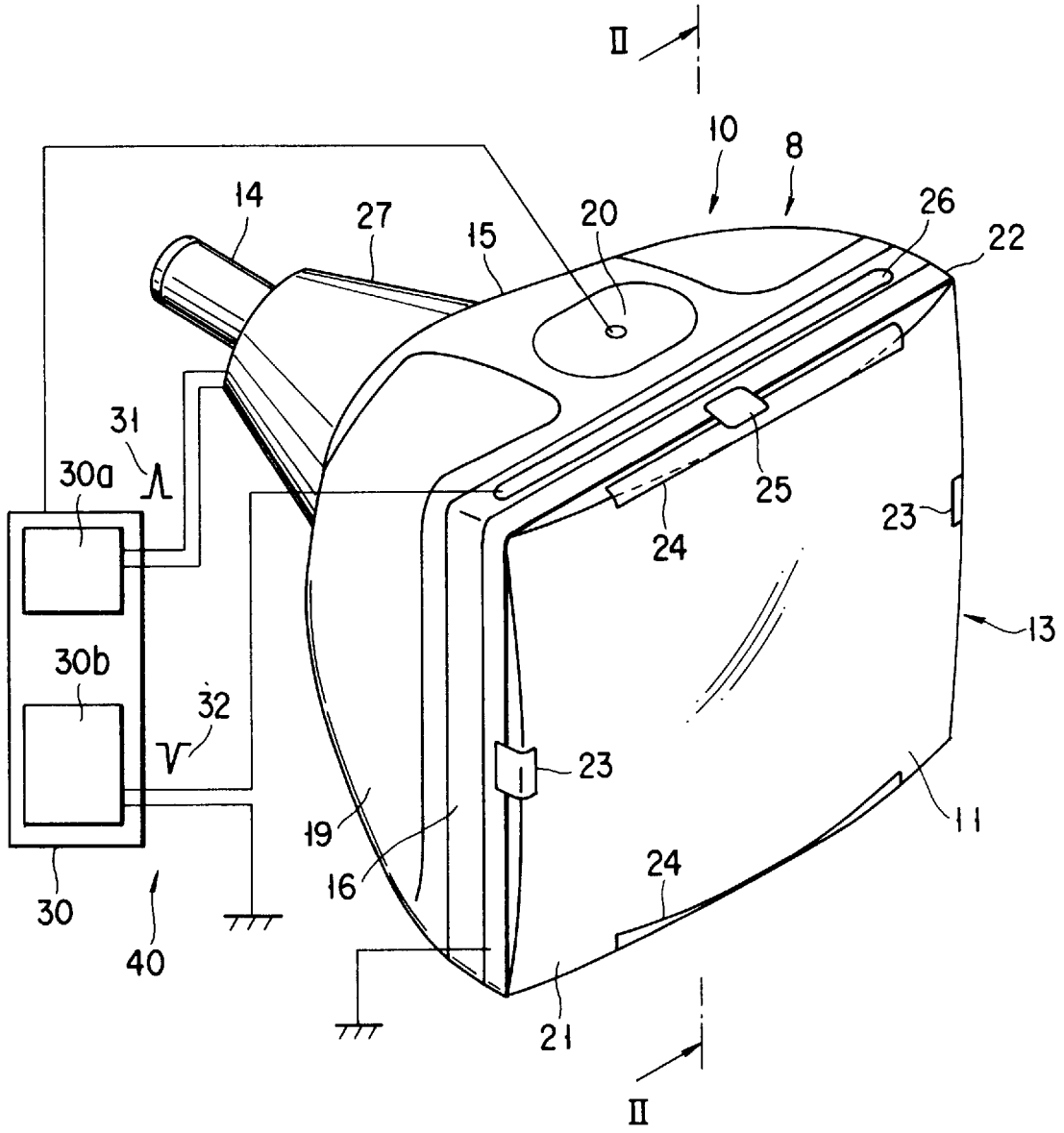
FIG. 1 is a perspective view of a cathode ray tube apparatus according to an embodiment of the present invention.
Figure 2:
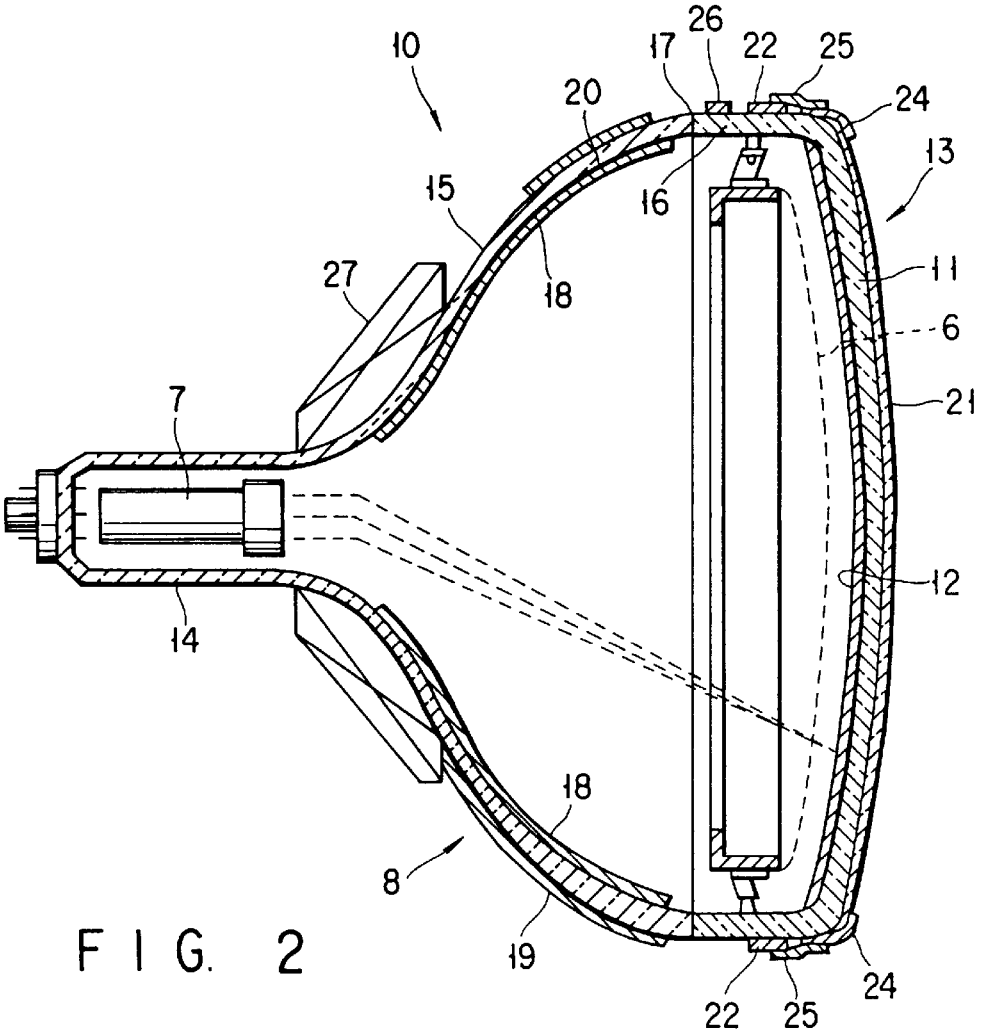
FIG. 2 is a sectional view taken along the lines II—II in FIG. 1.

A cathode ray tube apparatus comprises a cathode ray tube 10 and a drive circuit 40 for driving the cathode ray tube. As shown in FIGS. 1 and 2, the cathode ray tube 10 comprises a vacuum envelope 8 made of glass. The vacuum envelope 8 includes a face panel 13 having a substantially rectangular face portion 11 and a rectangular frame shaped skirt portion 16 standing on the peripheral edge of the face portion 11, a funnel 15 attached to the skirt portion 16 through frit glass, and a neck 14 extending from a smaller diameter end of the funnel.

A phosphor screen 12 is formed on an inner surface of the face portion 11. Within the vacuum envelope 8 is disposed a shadow mask 6 so as to oppose the phosphor screen 12. In the neck 14 is arranged an electron gun 7 for emitting electron beams toward the phosphor screen 12.

An internal conductive film 18 is formed on an inner surface of the funnel 15 and an external conductive film 19 made of graphite is formed on an outer surface thereof. Further, an anode terminal 20 for applying anode potential to the internal conductive film 18 is provided on the funnel 15. Static electric capacity is formed between the external conductive film 19 and the internal conductive film 18 so as to stabilize the potential. The external conductive film 19 is formed so as to be far from the anode terminal 20.

Transparent conductive film 21 is formed entirely over the outer surface of the face portion 11 of the face panel 13. Resistance per unit area of the transparent conductive film 21 is set to $1\times10^{10}$ Ω/□. Around an outer circumference of the skirt portion 16 is wound a metallic explosion proof band 22 having conductivity. Conductivity between the explosion proof band 22 and the transparent conductive film 21 is secured by two conductive tapes 23 adhered to a pair of short sides of the face panel 13.

Band-shaped conductive tapes 24 made of, for example, aluminum tape are adhered to long sides of the face panel 13 and conductivity between the conductive tape 24 and the explosion proof band 22 is secured by a conductive tape 25. A lengthwise size of the conductive tapes 24 which function as conductive band-shaped members is specified so as to be 50% or more an effective dimension of the long side of the face panel 13. A band-shaped compensating electrode 26 is fixed to a long side of the skirt portion 16 and extends in the lengthwise direction of the long side. The compensating electrode 26 is disposed on a side of the neck portion 14 with respect to the explosion proof band 22.

Figure 3:
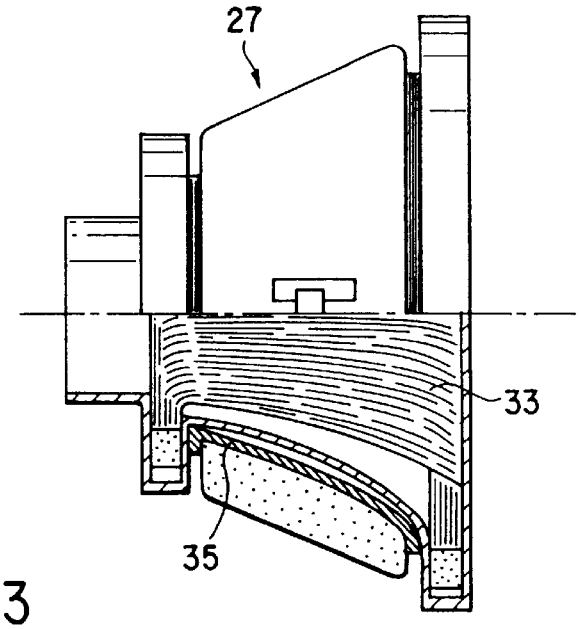
FIG. 3 is a side view of a deflection device of the cathode ray tube, partly in section.

A deflection device 27 is mounted outside of the funnel 15. This deflection device 27, as shown in FIG. 3, comprises a horizontal deflection coil 33 for generating horizontal deflection magnetic field for deflecting electron beams emitted from the electron gun 7 horizontally, and a vertical deflection coil 35 for generating vertical deflection magnetic field for deflecting the electron beams vertically. For example, the deflection device 27 is a saddle-saddle type deflection device in which the horizontal deflection coils 33 are formed of upper and lower saddle type deflection coils and the vertical deflection coils 35 are formed of left and right saddle type deflection coils.

As shown in FIG. 1, a high voltage deflection circuit 30 constituting part of the drive circuit 40 is connected to the horizontal and vertical deflection coils 33 and 35. The high voltage deflection circuit 30 has a voltage applying portion 30*a*. The voltage applying portion 30*a* applies voltages of predetermined waveforms, each of which changes at a predetermined frequency, to the horizontal deflection coils and the vertical deflection coils so as to generate deflection magnetic field. Usually voltage with a pulse waveform of several hundreds to 1 kV is applied to the horizontal deflection coils 33.

The high voltage deflection circuit 30 comprises an inverse voltage applying portion 30*b* for obtaining a voltage having a waveform 32 with a polarity inverse to that of the deflection voltage to be applied to the horizontal deflection coil of the deflection device 15. This inverse voltage applying portion 30*b* applies a voltage with the inverse polarity waveform 32 to the compensating electrode 26.

As described above, the compensating electrode 26 and the conductive tape 24 are disposed on that portion of the skirt portion 16 which is closed to the long side of the face panel 13 while the explosion proof band 22 is interposed between the compensating electrode 26 and the conductive tape 24. In particular, the compensating electrode 26 is located on the neck side and the conductive tape 24 is located on the face panel side with respect to the explosion proof band 22. The conductive tape 24 covers that area of the outer surface of the skirt portion 15 which is between the explosion proof band 22 and the transparent conductive film 21. The explosion proof band 22 and the external conductive film 19 provided on the outer surface of the funnel 15 are connected to the ground.

Figure 4A:
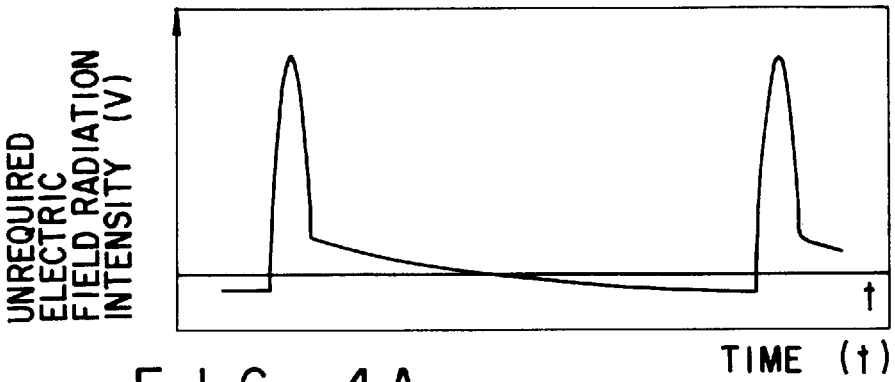
FIG. 4A is a graph indicating leaking alternating electric field resulting from a normal cathode ray tube apparatus.

An alternating electric field with a waveform shown in FIG. 4A leaks from a normal cathode ray tube apparatus not having above-mentioned conductive tape 24 and compensating electrode 26. The reason for generation of the leaking electric field can be considered as follows.

Figure 4B:
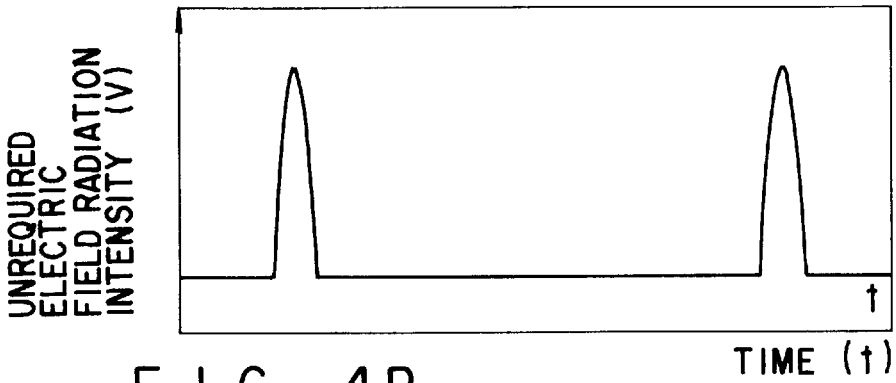
FIG. 4B is a graph indicating leaking alternating electric field generated due to the deflection coil.

A first possible reason is deviation of potential in the deflection device 27. When deflection voltage, which changes in a passage of time in synchronism with the deflection frequency, is applied to the deflection coil, the potential in the deflection coil spatially changes in a range from the high voltage side to the low voltage side within the deflection coil. This potential becomes higher than the grounding potential or the ground. Thus, fluctuating electric field is generated between the deflection coil and the ground. The alternating electric field leaking from the deflection device 27 when deflection voltage is applied to the deflection device has a waveform which is shown in FIG. 4B and which changes substantially in synchronism with the waveform of the deflection voltage shown in FIG. 5A.

Figure 4C:
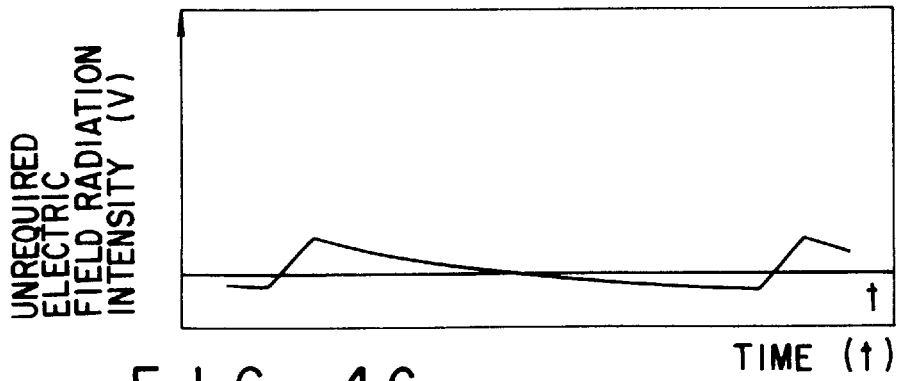
FIG. 4C is a graph indicating leaking alternating electric field resulting from the phosphor screen.

It has been noticed that a second reason is potential fluctuation in the phosphor screen. Specifically, in the image display period in the horizontal deflection cycle, negative charged electron beams emitted from the electron gun strike against the phosphor screen, thereby gradually lowering the potential of the phosphor screen, and in the retrace period, emission of electron beams from the electron gun is stopped so that the potential of the phosphor screen is restored. As a result, potential changes in the phosphor screen is generated so that sawtooth shaped potential fluctuation as shown in FIG. 4C is produced.

Due to both the first and second reasons, the alternating electric field having the waveform shown in FIG. 4A leaks from the normal cathode ray tube apparatus. But, according to this embodiment, the cathode ray tube apparatus generates inverse alternating electric field for compensating and restricting the leaking alternating electric field resulting from the deflection device 27, and then both the alternating electric filed and inverse alternating electric filed are synthesized so as to restrict the leaking alternating electric field. Further, according to this embodiment, by increasing static electric capacity between the inner and outer surfaces of the face panel, potential fluctuation in the phosphor screen 12 is restrained. Further, a gap between the explosion proof band 22 connected to the grounding and the transparent conductive film 21 on the surface of the face portion 11 is shielded.

For compensating the leaking alternating electric filed, the cathode ray tube apparatus according to this embodiment comprises the inverse pulse electric field generating mechanism, and the shielding structure, as shown in FIG. 1. The inverse pulse electric filed generating mechanism includes the high voltage deflection circuit 30 having the inverse voltage applying portion 30*b* and the compensating electrode 26 to which a voltage having a polarity inverse to the deflection voltage is applied from the inverse voltage applying portion. The shielding structure includes the conductive tape 24, serving as a conductive band-shaped member, electrically connected to the explosion proof band 22 through the conductive tape 25.

The compensating electrode 26 of the inverse pulse electric field generating mechanism is disposed on an upper longitudinal side wall of the skirt portion 16, which is in the vicinity of the anode terminal 20 on the funnel 15, and between the explosion proof band 22 and the funnel 15. This reason is that since the outer conductive film 19 made of graphite which is originally provided on the outer surface of the funnel 15 is not formed around the anode terminal 20, electric field leaking to the front side of the cathode ray tube is vertically asymmetrical so that it is stronger on the upper side of the face panel.

The compensating electrode 26 is mounted on the side of the neck 14 with respect to metal holders (not shown) for installing and mounting the cathode ray tube in a cabinet of the image display unit and which are provided on four corners of the explosion proof band 22. When the cathode ray tube is installed in a set such as a computer display, the metallic chassis of the display shields the sides and backs of the cathode ray tube. Thus, by arranging the compensating electrode at the above-mentioned position, leakage of the inverse pulse electric field to the sides of a set can be eliminated.

Figure 5A:
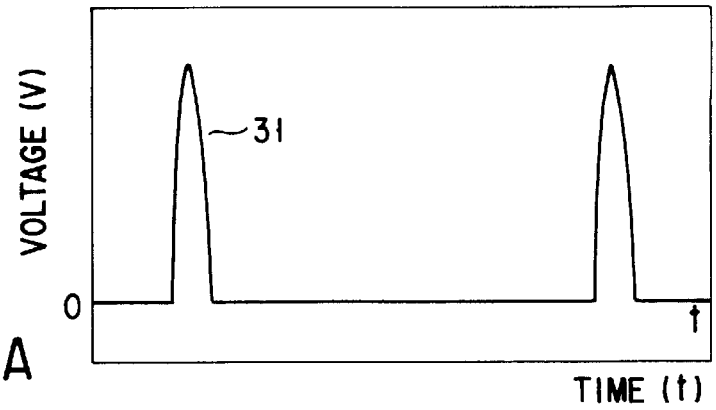
FIG. 5A is a graph indicating deflection voltage to be applied to the deflection coil.
Figure 5B:
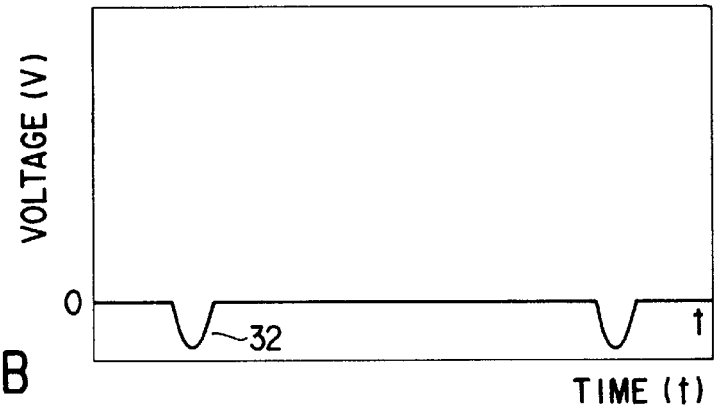
FIG. 5B is a graph indicating an inverse pulse voltage to be applied to a compensating electrode.

The inverse voltage applying portion 30*b* generates the inverse pulse voltage 32, as shown in FIG. 5B, of the same frequency, phase and polarity inverse to the deflection voltage 31 to be applied to the horizontal deflection coil of the deflection device 27 shown in FIG. 5A. By adjusting the peak value of the inverse pulse voltage 32 and size of the compensating electrode 26, the inverse pulse electric field irradiated from the compensating electrode 26 cancels the pulse electric field irradiated from the horizontal deflection coil.

This embodiment is particularly valid in the cathode ray tube in which the transparent conductive film 21 on the surface of the face portion 11 is formed according to the spin coat method. Although the transparent conductive film 21 is formed up to the peripheral edge of the surface of the face portion 11 if the spin coat method is utilized, coating fluid does not spread easily up to the skirt portion 16. Thus, the transparent conductive film is not formed in the vicinity of the front end of the explosion proof band 22 so that leak of electric field is likely to occur.

When the conductive tape is attached to the periphery of the surface of face portion as described in Jpn. Pat. Appln. KOKAI Publication No. 4-249036, an effect of increasing the static electric capacity is low particularly in a case when a low resistance transparent conductive film is formed, because this is a place in which the conductive film is originally provided. However, if the conductive tape 24 is adhered to a place, in which the transparent conductive film 21 is not provided, and connected to the grounding, like this embodiment, it comes that electric field shield is formed at a place in which the electric field shield is not existent, thereby providing great effects in reducing both pulse type alternating electric field from the horizontal deflection coil irradiated to the front of the image display unit and sawtooth shaped alternating electric field resulting from potential fluctuation in the phosphor screen.

The inventors of this invention utilized an image display unit having a cathode ray tube 41 cm diagonally in the experiments. $2\times10^5$ Ω/□ transparent conductive film 21 was formed on the surface of the face portion 11 of the cathode ray tube and aluminum tapes 23 of 30 mm square were adhered to the short sides of the conductive film to electrically connect the conductive film to the explosion proof band 22. Further, aluminum tapes 24 of 15 mm in width, 240 mm in length were adhered in the vicinity of the skirt portion 16 of the long sides and connected electrically to the explosion proof band 22 by an aluminum tape 25 of 30 mm square. By providing the aluminum tapes 24 on the long sides of the skirt portion 16, unrequired radiant electric field intensity at a position apart from the front of the cathode ray tube by 30 cm can be reduced from 3.4 (V/m) to 2.7 (V/m).

Figure 6:
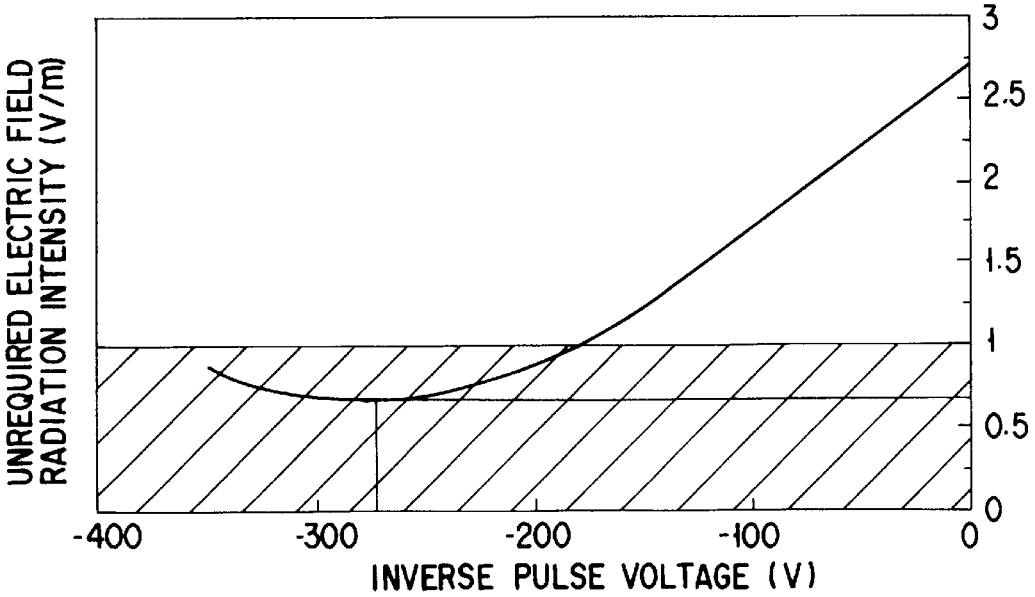
FIG. 6 is a graph indicating a relation between the inverse pulse voltage and unrequired radiant electric field intensity.

The compensating electrode 26 is formed by sandwiching a copper foil of 10 mm in width, 290 mm in length with insulators and an end of lead wire wound around a fly-back transformer core of the image display unit is connected to the compensating electrode while the other end of the lead wire is connected to the grounding. Then, the number of windings of the lead wire is changed to adjust the peak voltage of inverse pulse. Consequently, a relation between the inverse pulse voltage and unrequired radiant electric field intensity as shown in FIG. 6 has been obtained. The inverse pulse voltage is desired to be set such that the unrequired radiant electric field intensity is within an appropriate range indicated by hatching in the Figure.

From this experiment, it has been noticed that the unrequired radiant electric field intensity can be improved from a conventional value of 2.7 (V/m) to 0.7(V/m) by optimization of the inverse pulse peak voltage, for example, by setting to about −270V in the above embodiment.

As described above, the cathode ray tube apparatus having the above-mentioned structure is capable of effectively reducing alternating electric field of VLF band for each cause of occurrence and consequently, a cathode ray tube apparatus which satisfies the TCO guide line can be obtained.

It is noted that the present invention is not limited to the above embodiment but can be modified in various forms within a scope of the present invention. For example, although the above embodiment is so structured that a single compensating electrode 26 is provided on only the upper side of the face panel, it is permissible to provide a pair of the compensating electrodes on the upper and lower sides of the face panel. Further, the band-shaped conductive member adhered in the vicinity of the boundary between the skirt portion and the long side of the face portion may be provided on the short side of the face portion or may be provided to both the long and short sides thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode ray tube comprising:

an envelope including a face panel having a substantially rectangular face portion and a rectangular frame-like skirt portion extending from the peripheral edge of the face portion, a funnel attached to the skirt portion, and a neck extending from the funnel;

a phosphor screen formed on an inner surface of the face portion;

a transparent conductive film formed on an outer surface of the face portion;

an explosion proof band having conductivity and wound around an external surface of the skirt portion;

an electron gun disposed in the neck, for emitting an electron beam toward the phosphor screen;

a deflection device arranged around an outer circumference of the funnel, for deflecting the electron beam;

a band-shaped conductive member provided on the outer surface of the face panel and electrically connecting the transparent conductive film to the explosion proof band; and a compensating electrode disposed on the outer surface of the skirt portion and to which a voltage, having a waveform of a polarity inverse to a deflection voltage applied to the deflection device, is applied.

2. A cathode ray tube according to claim 1, wherein the compensating electrode is disposed on the skirt portion and between the explosion proof band and the funnel.

3. A cathode ray tube according to claim 2, wherein an anode terminal is provided on the funnel and the compensating electrode is disposed on that side of the skirt portion which is in the neighborhood of the anode terminal.

4. A cathode ray tube according to claim 1, wherein the band-shaped conductive member is disposed along one side of the face portion, and has a length-wise size which is 50% or more an effective size of said one side of the face portion.

5. A cathode ray tube according to claim 4, wherein the band-shaped conductive member is disposed on a side of the explosion proof band, opposite to the compensating electrode.

6. A cathode ray tube according to claim 5, wherein the band-shaped conductive member is disposed so as to cover that area on the outer surface of the skirt portion which is located between the explosion proof band and the transparent conductive film.

7. A cathode ray tube according to claim 1, wherein the transparent conductive film has a resistance equal to or lower than $1\times10^{10}$ Ω/□ per unit area.

8. A cathode ray tube apparatus comprising:

an envelope including a face panel having a substantially rectangular face portion and a rectangular frame-like skirt portion extending from the peripheral edge of the face portion, a funnel attached to the skirt portion, and a neck extending from the funnel;

a phosphor screen formed on an inner surface of the face portion;

a transparent conductive film formed on an outer surface of the face portion;

an explosion proof band having conductivity and wound around an external surface of the skirt portion;

an electron gun disposed in the neck, for emitting an electron beam toward the phosphor screen;

a deflection device arranged around an outer circumference of the funnel, for deflecting the electron beam;

a band-shaped conductive member provided on the outer surface of the face panel and electrically connecting the transparent conductive film to the explosion proof band;

a compensating electrode disposed on the outer surface of the skirt portion; and drive means including a voltage applying portion for applying a deflection voltage with a predetermined waveform to the deflection device, and an inverse voltage applying portion for applying a voltage having a waveform with a polarity inverse to that of the deflection voltage to the compensating electrode.

9. A cathode ray tube apparatus according to claim 8, wherein the compensating electrode is disposed on the skirt portion and between the explosion proof band and the funnel.

10. A cathode ray tube apparatus according to claim 9, wherein an anode terminal is provided on the funnel and the compensating electrode is disposed on that side of the skirt portion which is in the neighborhood of the anode terminal.

11. A cathode ray tube apparatus according to claim 8, wherein the band-shaped conductive member is disposed along one side of the face portion, and has a length-wise size which is 50% or more an effective size of said one side of the face portion.

12. A cathode ray tube apparatus according to claim 11, wherein the band-shaped conductive member is disposed on a side of the explosion proof band, opposite to the compensating electrode.

13. A cathode ray tube apparatus according to claim 12, wherein the band-shaped conductive member is disposed so as to cover that area on the outer surface of the skirt portion which is located between the explosion proof band and the transparent conductive film.

14. A cathode ray tube apparatus according to claim 8, wherein the transparent conductive film has a resistance equal to or lower than $1\times10^{10}$ Ω/□ per unit area.

* * * * *